US005431462A

United States Patent [19]

Lignell

[11] Patent Number: 5,431,462

[45] Date of Patent: Jul. 11, 1995

[54] SECURE DOOR LATCH FOR A VEHICLE

[75] Inventor: Kirk R. Lignell, Ypsilanti, Mich.

[73] Assignee: Ford Motor Company, Dearborn, Mich.

[21] Appl. No.: 254,859

[22] Filed: Jun. 6, 1994

[51] Int. Cl.[6] ..... E05C 3/26

[52] U.S. Cl. ..... 292/336.3; 292/216

[58] Field of Search ..... 292/336.3, DIG. 4, DIG. 23, 292/267, 216

[56] References Cited

U.S. PATENT DOCUMENTS

| | | | |
|---|---|---|---|
| 2,931,231 | 5/1960 | Felix | 292/216 |
| 3,233,931 | 2/1966 | Peras | 292/DIG. 23 |
| 3,596,482 | 8/1971 | Pollak | 292/DIG. 23 |
| 3,596,960 | 8/1971 | Mayer | 292/216 |
| 3,799,596 | 3/1974 | Nozomu et al. | 292/216 |
| 4,052,094 | 10/1977 | Widen | 292/336.3 |
| 4,158,996 | 6/1979 | Marulic et al. | 292/216 |
| 4,382,622 | 5/1983 | Ishikawa | 292/216 |
| 4,886,307 | 12/1989 | Rückert | 292/216 |
| 4,906,035 | 3/1990 | Nagai et al. | 292/216 |
| 5,069,493 | 12/1991 | Mochida et al. | 292/336.3 |
| 5,253,906 | 10/1993 | Rogers, Jr. et al. | 292/336.3 |

FOREIGN PATENT DOCUMENTS

| | | | |
|---|---|---|---|
| 64-256281 | 5/1991 | Japan | E05B 65/20 |

*Primary Examiner*—Peter M. Cuomo
*Assistant Examiner*—Monica E. Millner
*Attorney, Agent, or Firm*—Daniel M. Stock; Roger L. May

[57] ABSTRACT

A latch mechanism for a vehicle enables the vehicle to withstand fore, aft and side impacts without operating the latch. A linkage assembly has two links connecting the door handle and door latch. The links are connected to one another at a pivot point. The pivot point connecting the links in the vehicle door moves vertically to operate the latch in response to operation of the door handle. The pivot point is free to move horizontally fore, aft and sideways without operating the latch. By having this freedom of movement, the pivot point is free floating so that the vehicle can withstand fore, aft and side impacts without operating the latch.

8 Claims, 2 Drawing Sheets

FIG. 1
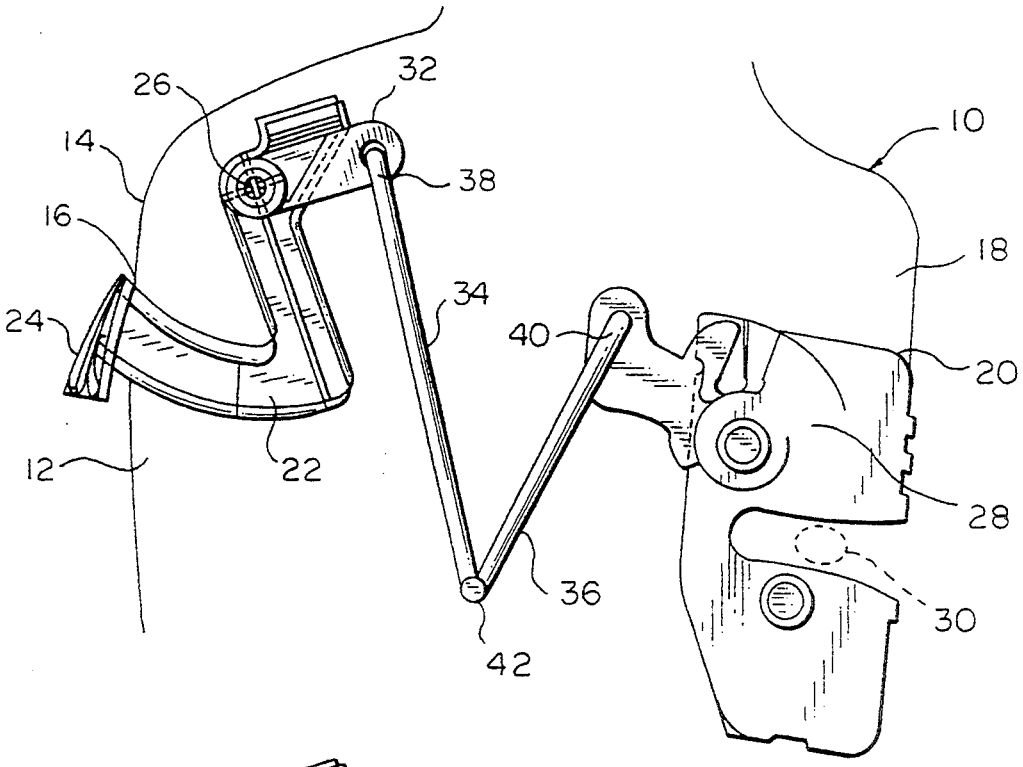
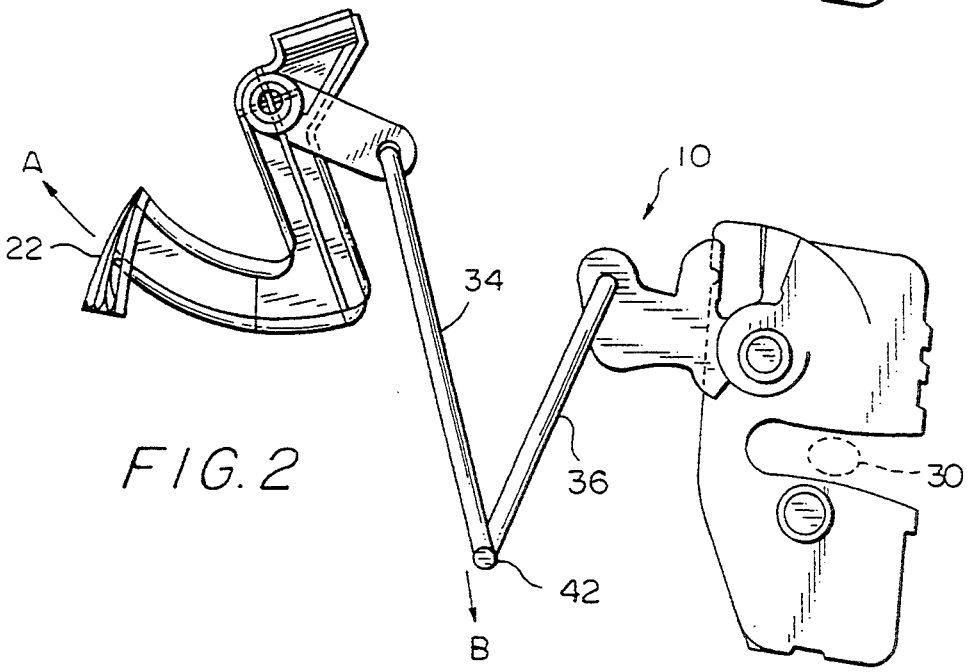
FIG. 2
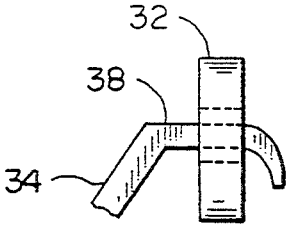
FIG. 3

SECURE DOOR LATCH FOR A VEHICLE

FIELD OF THE INVENTION

The present invention relates to a latch mechanism for a vehicle door.

BACKGROUND OF THE INVENTION

Vehicle doors, especially automobile doors, have elaborate latching mechanisms so the door can be opened from within the vehicle as well as outside the vehicle. Ideally, the latch operates by deliberate operation of the door handle. During operation, a vehicle may be subjected to fore, aft or side forces which may cause the latch to operate. Accordingly, it will be appreciated that it would be highly desirable to have a vehicle door latching mechanism that can withstand fore, aft or side forces without operating. Sometimes the point of impact generating the forces is the vehicle door. It is also desirable for the latch to remain locked when the side forces are generated at the vehicle door.

SUMMARY OF THE INVENTION

The present invention is directed to overcoming one or more of the problems set forth above. Briefly summarized, according to the present invention, a mechanism for a door of a vehicle includes a bell crank connected to the door handle, a latch attached to the door, and a linkage assembly connecting the latch and handle. The linkage assembly has a first link with one end portion pivotally connected to the bell crank and a second link with one end portion pivotally connected to the latch. The links are pivotally connected to one another at a point of mutual connection below the bell crank and latch that moves vertically in response to operation of the door handle to operate the latch. The links and the pivot point being free to move horizontally fore, aft and sideways without operating the latch.

The point of mutual connection is free floating so that the vehicle can withstand fore, aft and side impacts without operating the latch. The free floating pivot point makes the door latch a secure door latch which is less sensitive to impacts. Free movement of the pivot point in fore, aft and side directions permits relative movement between the latch and handle without operating the latch.

These and other aspects, objects, features and advantages of the present invention will be more clearly understood and appreciated from a review of the following detailed description of the preferred embodiments and appended claims, and by reference to the accompanying drawings.

BRIEF DESCRIPTION OF THE DRAWINGS

FIG. 1 is a diagram of a preferred embodiment of vehicle door and latching mechanism according to the present invention with the latch closed.

FIG. 2 is a diagram similar to FIG. 1 but with the latch open.

FIG. 3 is an end view of the bell crank of FIGS. 1 and 2 with a linkage member.

DETAILED DESCRIPTION OF THE PREFERRED EMBODIMENTS

Figure 4:
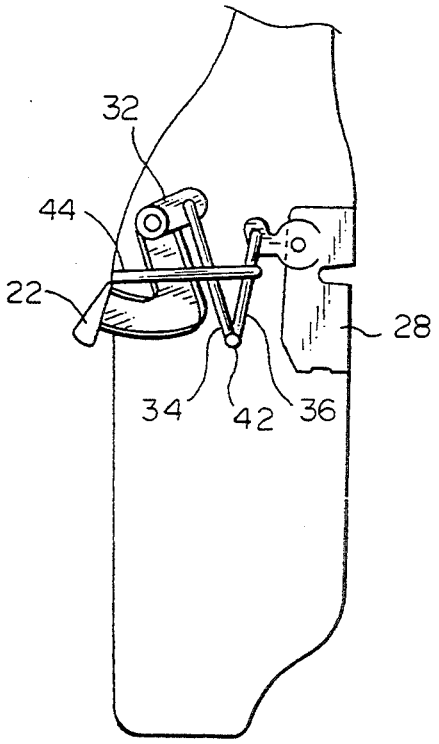
FIG. 4 is a diagrammatic end view similar to FIG. 1, but illustrating a stabilizing bracket.

Referring to FIGS. 1 and 2, a door 10 of a vehicle has a hollow interior 12, an exterior panel 14 with an opening 16 in communication with the hollow interior 12, and an edge surface 18 with an opening 20 in communication with the hollow interior 12. A handle 22 is provided for opening the door 10.

The door handle 22 has an exterior portion 24 that extends from the exterior panel opening 16. A pivot pin 26 connects the door handle 22 to the door and serves as a pivot point for the pivotal movement of the door handle 22. The door handle is operated by pulling out on the exterior handle portion 22 causing the exterior handle portion 22 to pivot outwardly away from the exterior panel 14 and upwardly about the pivot pin 26.

A latch 28 is attached to the edge surface 18 of the door 10. The latch 28 is operable between an open position at which the latch 28 is free of locking engagement with a striker 30 and a closed position at which the latch 28 engages the striker 30 in locking contact. As is known in the art the latch cooperates with a striker attached to the door frame.

A bell crank 32 is connected to the door handle 22 in the hollow interior 12 of the door 10. Pivotal movement of the handle 22 causes movement of the bell crank 32. As illustrated, movement of the bell crank 32 is pivotal to move a distal end of the bell crank up and down in a slight arc.

A linkage assembly has first and second links 34, 36 positioned in the hollow interior 12 of the door 10. The first link 34 has one end 38 pivotally connected to the bell crank 32 while the second link 36 has one end 40 pivotally connected to the latch 28. FIG. 3 illustrates the connection of the bell crank 32 and first end portion 38 of the first link 34. It is seen that the end portion 38 has an amount of play so that it can move horizontally in the opening. The end 38 protrudes through an opening in the link 32 and is preferably bent downward for retention in the opening. Alternatively, the end portion 38 may be retained by an end cap, clip, cotter pin, nut, or other means. Similarly, the second link is connected to the latch to have an amount of play so that the end of the link can move horizontally.

At a point of mutual connection 42 below the latch 28 and bell crank 32, the first and second links 34, 36 are joined together. The pivot point 42 may be formed by pinning the links together, or a threaded joint may be used. It is also possible to have a single member that is bent or folded to form a pivot point and two links. Pivot point 42 moves vertically in response to operation of the door handle 22 which operates the bell crank 32 to move the first link 34. Vertical movement of pivot point 42 causes the second link 36 to move and operate the latch 28. The first and second links 34, 36 and the pivot point 42 are free to move horizontally fore, aft and sideways without operating the latch 28. The pivot point 42 is thus free floating so that the vehicle can withstand fore, aft and side impacts without operating the latch 28.

Figure 5:
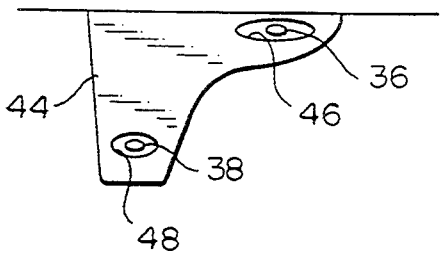
FIG. 5 is a top view of the bracket of FIG. 4.

Referring to FIGS. 4–5, a stabilizing bracket 44 is positioned in the hollow interior 12 of the door 10 and attached to the exterior door panel 14. The bracket 44 has a first opening or slot 46 through which the second link 36 extends. Alternatively, the second link 36 may extend between the bracket 44 and door panel 14. The bracket 44 also has a second opening or slot 48 through which the first link 34 extends. As illustrated, the openings 46, 48 are horizontally and laterally offset from one another to accommodate the links. The bracket 44 limits unwanted movement and constrains the links 34, 36 to move within a predetermined range and thereby discourage rattling. The links 34, 36 or bracket 44, or both, may be coated with a material to reduce noise occasioned by metal to metal contact.

Figure 6:
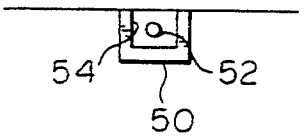
FIG. 6 is a top view similar to FIG. 5, but illustrating another embodiment.
Figure 7:
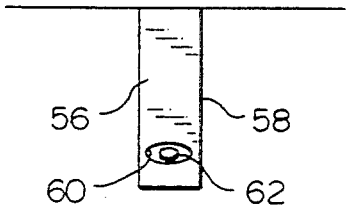
FIG. 7 is a top view similar to FIGS. 5 and 6, but illustrating another embodiment.

FIG. 6 illustrates a bracket 50 for use with a single link 52. The bracket 50 is a U-shaped bracket that restrains the second link 52 between the bracket and door panel. The bracket 50 has an opening or slot 54 through which the second link 52 extends. FIG. 7 illustrates a bracket 56 which includes a stand off or extension 58 with an opening 60 for holding the first link 62 at the desired location.

Operation of the present invention is believed to be apparent from the foregoing description and drawings, but a few words will be added for emphasis. FIG. 1 illustrates the mechanism with the door closed and handle close to the door panel in the normal closed position. The door 10 is opened by pulling the handle 22 out away from the door in the direction of arrow A causing the handle to pivot about the pivot pin 26. Handle movement causes the bell crank 32 to pivot downward in the direction of arrow B pushing the first link 34 and the pivot point 42 vertically downward. Downward movement of the pivot point 42 pulls the second link 36 vertically downward causing the latch 28 to operate moving from its closed position (FIG. 1) to its open position (FIG. 2). There must be downward vertical motion of the pivot point 42 to operate the latch. The pivot point is therefore free to move fore, aft and sideways without operating the latch because only vertical downward movement of the pivot point opens the latch.

During fore, aft or sideways impacts, there is no downward vertical movement of the pivot point. It is readily seen that in fore and aft impacts the pivot point may move horizontally. During a side impact, even a side impact tending to force the door handle toward the interior of the door, the force will be a horizontal force. Such a horizontal force may cause the handle to pivot about its pivot pin, but the pivoting will be inward causing the bell crank to raise the pivot point vertically upward to keep the latch closed. A horizontal force causes the links to close, like scissors, without vertically moving the pivot point. There can be relative motion between the handle and latch without operating the latch.

The bracket holds the links in position and limits their movement without interfering with their operation. Limiting the movement reduces random contact with other components to promote quiet operation.

It can now be appreciated that there has been presented a vehicle door latching mechanism with which the vehicle can withstand front, rear and side impacts with the latch remaining closed, even when the point of impact is the door. A free floating pivot point makes the latch a secure door latch that withstands impacts. The floating pivot point permits relative movement between the latch and handle without operating the latch.

While the invention has been described with particular reference to an automobile door, it is apparent that the secure door latch is easily adapted to other vehicles. As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

What is claimed is:

1. A mechanism for a door of a vehicle, said vehicle having a striker, said door having a hollow interior portion, an exterior panel with an opening in communication with said hollow interior portion, an edge surface with an opening in communication with said hollow interior, and a door handle with an exterior portion extending from said exterior panel opening, said mechanism comprising:

a bell crank connected to said door handle in said hollow interior portion of said door;

a latch attached to said door and operable between an open position at which said latch is free of locking engagement with said striker and a closed position at which said latch engages said striker in locking contact; and a linkage assembly having a first link with one end portion pivotally connected to said bell crank and a second link with one end portion pivotally connected to said latch, said first and second links being pivotally connected to one another at a moveable pivot point of mutual connection below said bell crank and latch that moves vertically in response to operation of said door handle to operate said latch, said first and second links and said pivot point being free to move horizontally fore, aft and sideways a preselected mount without operating said latch.

2. A mechanism, as set forth in claim 1, wherein said first link one end portion fits through an opening in said bell crank and including means for connecting said first link one end portion and said bell crank so that said first link one end portion moves laterally and horizontally in said bell crank opening without vertically moving said pivot point; and wherein said second link one end portion fits through an opening in said latch and including means for connecting said second link one end portion and said latch so that said second link one end portion moves laterally and horizontally in said latch opening without vertically moving said pivot point so that said pivot point is free floating laterally and horizontally whereby said vehicle can withstand fore, aft and side impacts without opening said latch.

3. A mechanism, as set forth in claim 1, including a stabilizing bracket attached to said exterior panel in said hollow interior portion of said door confining one of said first and second links and limiting fore, aft and sideways movement of said one link.

4. A mechanism, as set forth in claim 3, wherein said one link is confined between said exterior panel and said bracket.

5. A mechanism, as set forth in claim 3, wherein said bracket has an opening confining said one link.

6. A mechanism, as set forth in claim 1, including a stabilizing bracket attached to said exterior panel in said hollow interior portion of said door horizontally and laterally confining said first and second links.

7. A mechanism, as set forth in claim 6, wherein said bracket has an opening confining one of said links.

8. A mechanism, as set forth in claim 6, wherein said bracket has first and second openings and said first link is confined in said first bracket opening and said second link is confined in said second bracket opening.

* * * * *